United States Patent [19]

Conklin et al.

[11] 4,401,782

[45] Aug. 30, 1983

[54] HOT MELT SIZE AND YARNS SIZED THEREWITH

[75] Inventors: Delano M. Conklin, Burlington; John H. Hansen; John B. Hodgin, both of Greensboro, all of N.C.

[73] Assignee: Burlington Industries, Inc., Greensboro, N.C.

[21] Appl. No.: 441,865

[22] Filed: Nov. 15, 1982

Related U.S. Application Data

[63] Continuation-in-part of Ser. No. 257,315, Apr. 17, 1981, abandoned, which is a continuation-in-part of Ser. No. 147,335, May 6, 1980, abandoned.

[51] Int. Cl.[3] ..... C08L 23/08; D06M 15/16; D06L 1/06

[52] U.S. Cl. ..... 524/313; 8/115.6; 428/394; 524/275; 524/321; 524/489; 524/556

[58] Field of Search ..... 428/394; 8/115.6; 524/275, 313, 321, 489, 556

[56] References Cited

U.S. PATENT DOCUMENTS

| | | | |
|---|---|---|---|
| Re. 29,287 | 7/1977 | Illman et al. | 28/178 |
| 2,273,780 | 2/1942 | Dittmar | 524/272 |
| 2,702,796 | 2/1955 | Fine | 524/220 |
| 2,845,398 | 7/1958 | Brown et al. | 524/96 |
| 3,436,363 | 4/1969 | Helin | 524/817 |
| 3,466,717 | 9/1969 | Kuroda | 28/180 |
| 3,520,861 | 7/1970 | Thomson | 156/326 |
| 4,015,317 | 4/1977 | Johnsen | 8/138 |
| 4,082,883 | 4/1978 | Malpass et al. | 28/178 |
| 4,136,069 | 1/1979 | Vachon | 524/317 |
| 4,253,840 | 3/1981 | Illman et al. | 8/115.6 |

FOREIGN PATENT DOCUMENTS 40-14280 7/1965 Japan .

OTHER PUBLICATIONS

Melliand, "Textilbericute", Apr. 1975, p. 262.

Webster's New Collegiate Dictionary, G. & C. Merriam Co., Publishers, Springfield, Mass., U.S.A., 1956, p. 992.

*Primary Examiner*—Ronald W. Griffin

*Attorney, Agent, or Firm*—Cushman, Darby & Cushman

[57] ABSTRACT

Non-aqueous, quick setting sizing compositions suitable for application as a melt to textile yarns, and for later removal by solvent or aqueous means, characterized by substantial amounts of hydrogenated tallow-type triglyceride wax, are disclosed. The compositions may include an approximately 50:50 weight mixture of a specific class of 80/20 ethylene/acrylic acid copolymers intimately blended with an equal amount of the wax. A fatty acid amide may be included in an amount up to about 7 weight percent of the composition or from 1 to 14 weight percent sebacic acid or dodecanedioic acid, the amount of copolymer being reduced accordingly. The compositions may contain up to 62 weight percent of the wax, and rigidify at ambient temperatures.

18 Claims, No Drawings

HOT MELT SIZE AND YARNS SIZED THEREWITH

CROSS-REFERENCE TO RELATED APPLICATIONS

This is a continuation-in-part of our copending application Ser. No. 257,315, filed Apr. 17, 1981, now abandoned, which is a continuation-in-part of our earlier copending application Ser. No. 147,335, filed May 6, 1980, now abandoned.

BACKGROUND OF THE INVENTION

This invention relates to the hot melt sizing of textile warp yarns, more specifically to a novel class of non-aqueous warp sizes which are applied to yarn in the form of a melt.

For some years it has been recognized that a system for melt sizing of warp yarns would offer many advantages. At the sizing symposium of Sept. 9–12, 1974 in Budapest, Hungary (Melliand Textilberichte, English Edition, April, 1975, p. 262), it was observed, with respect to sizing machines and sizes: "All problems related with drying (energy costs, error sources) can be avoided, if sizing agents can be used which rigidify at room temperature. At present there is no satisfactory and practical solution; but it is probable that melt sizes will be important in the future." Both before and since that time ongoing research on melt sizes and melt sizing methods and apparatus has led to the development and patenting of a number of new size compositions. Various deficiencies, principally economic in nature, have nevertheless limited the commercial acceptability of these sizes.

U.S. Pat. No. 3,466,717 describes a method and apparatus for sizing warp yarns, in which size is applied within a sizing chamber provided with a vat containing a quick-solidifying molten size whose predominant component is wax. Exemplified for application in this apparatus is a molten size made with hardened castor oil, 2-ethylhexyl acrylate, and benzoyl peroxide, one of a number of sizes described in Japanese Patent Publication No. 14280/1965 (issued Dec. 22, 1965, as Japanese Pat. No. 462,254). More broadly, the latter publication describes certain classes of polymers or copolymers soluble in specified types of wax, capable of application to yarns by melt means. Three facts in this publication are particularly significant in the context of the present invention. The first is its emphasis upon high compatibility of its various simple or mixed polymer components with its wax components. The second is that at least 20 percent of a hydrophobic vinyl monomer, such as 2-ethylhexyl acrylate, must be present in its polymeric component if compatibility with the wax is to be achieved. The third is that a substantial portion of an ester of a hydroxycarboxylic acid, such as found in hydrogenated castor oil or esters of hydroxyacids such as tartaric acid, must be present. A minimum of 40 percent of this special kind of hydroxy ester wax is required as a component in the size compositions described in the Japanese patent publication.

Corollary to these facts is the publication's insistence on a 60 percent maximum of hydrogenated tallow in the wax component itself, which latter serves as solvent for the polymeric component. More specifically, the document's examples show no size composition containing in excess of 24 percent of hydrogenated tallow. The Japanese patent publication clearly does not contemplate the use of high proportions, i.e., in the order of 50 percent, of readily available hydrogenated tallow in a melt size composition.

U.S. Pat. No. 4,136,069 describes melt sizes made from a polymeric blend of high molecular weight with low molecular weight ethylene/$\alpha,\beta$-unsaturated carboxylic acid copolymers, such, for example, as blends of high with low molecular weight ethylene/acrylic acid copolymers. These melt blends are employed as sizes either alone or in conjunction with 0–50 percent of one or more $C_5$–$C_{12}$ dicarboxylic acids and/or with 0–30 percent, preferably 5–20 percent, of wax, fatty acid, or monoglyceride. With regard to the wax component, the patent makes no mention of animal or vegetable wax. Fischer-Tropsch or predominantly hydrocarbon waxes, the only classes of wax identified by name, are represented as only a minor substituent in a single example, at a level of 2.5 percent, in conjunction with 17.5 percent of a monoglyceride.

It is therefore an object of the present invention to provide a melt size containing substantially more hydrogenated tallow or equivalent triglyceride wax than hitherto tolerable in textile melt sizes.

It is a further object of the present invention to provide a melt size that is removable from fabric by either aqueous or organic solvent extraction or scouring means.

It is a further object of the present invention to provide a melt size exhibiting minimal smoking and fuming during hot melt size application to yarn.

It is a further object of this invention to provide a melt size giving superior weaving through the enhanced abrasion resistance and fiber laydown of staple yarns to which it has been applied.

These and other objects will be apparent from the following detailed description of our invention.

SUMMARY OF THE INVENTION

According to the present invention approximately equal weight amounts of fully hydrogenated tallow-type triglyceride wax and a specific ethylene/acrylic acid copolymer are melted together to form a superior textile melt size. Optionally, the lower limit of the copolymer content may be further reduced to as low as about 35 percent by weight by incorporation of from about one to seven percent of a hydrogenated tallow amide or other fatty acid amide, thereby further increasing the tallow-type component.

Another embodiment of the invention incorporates from about one to about fourteen percent of sebacic acid or dodecanedioic acid into blends of various proportions of copolymer and wax.

Unlike more complex melt size mixtures from the art, neither highly specific polymer blends nor low contents of inexpensive hydrogenated triglyceride wax are required to insure good sizing performance. The unexpected advantages of the melts of the present invention are thus achieved without loss of either performance or economic merit.

Hydrogenated tallow, the preferred triglyceride wax of the invention, has long been known, and the art suggests that its potential merit as a melt size component has evidently been recognized for many years. Nonetheless its utilization in high proportions in a melt size in conjunction with a single and commercially available polymer represents a surprising and commercially important advance in the melt sizing of textile warp yarns.

DETAILED DESCRIPTION OF THE INVENTION

In one embodiment the hot melt size compositions of the present invention comprise an essentially two-component melt blend of about 42 to 58 weight percent of substantially 80/20 ethylene/acrylic acid copolymer in conjunction with about 58 to 42 weight percent of fully hydrogenated tallow-type triglyceride wax. Optionally and preferably the copolymer content may be reduced to as little as about 35 weight percent by incorporation of one to seven percent of $C_{14-20}$ fatty acid amide or one to fourteen percent of sebacic or dodecanedioic acid, and wherein the copolymer has a standard melt flow rate value of 250–550 when determined by ANSI/ASTM D 1238–79 at condition D. Thus in its broadest aspect the melt sizes of the present invention comprise two- or three-component melt blends of about 35 to 58 weight percent of ethylene/acrylic acid copolymer and about 62 to 40 weight percent of a fully hydrogenated triglyceride such as hydrogenated tallow, together with from 0 up to about 7 weight percent of $C_{14-20}$ fatty acid amide or from 0 up to about 14 percent of sebacic acid or dodecanedioic acid.

In the two-component sizes we have found that composition ranges of about 45 to 55 weight percent of substantially 80/20 ethylene/acrylic acid and about 55 to 45 percent of hydrogenated triglyceride give the best results, with optimum melt sizing properties being centered around substantially 50:50 weight proportions of these components. The preferred triglyceride is hydrogenated tallow.

In the 3-component embodiment of the invention, the content of ethylene/acrylic acid copolymer in the size may be reduced below about 45 percent, to as low as about 35 percent, without significant loss of sized yarn performance. The melt size of this embodiment comprises about 35 to 45 percent, preferably about 38 to 42 percent, of substantially 80/20 ethylene/acrylic acid copolymer, about 62 to 54 percent, preferably about 60 to 56 percent, of hydrogenated triglyceride, and about 1 to 7 percent, preferably about 2 to 5 percent, of fatty acid amide. Incorporation of the amide appears to increase the miscibility range of the copolymer and hydrogenated triglyceride, thereby permitting the use of less copolymer in the melt size.

The preferred compositions of the present invention comprising about 35 to about 50 percent ethylene/acrylic acid copolymer, about 60 to about 40 percent hydrogenated triglyceride wax, and about 1 to 14 percent sabacic acid or dodecanedioic acid exhibit an expanded range of melt compatibility such that they can be melted and applied to yarn at significantly lower temperatures, i.e., up to around 50° F. lower, than the two-component copolymer/tallow blends. Increased compatibility is closely associated with temperature rise, and the capacity for decreased temperature without component separation of the melt is particularly advantageous. The blends containing sebacic acid or dodecanedioic acid further exhibit greatly improved resistance to smoking at melt temperature, only part of this resistance seeming to be attributable to their lower melting and application temperatures. They also exhibit markedly increased thermal stability, compared to the blends of the invention not containing either of the acids. For maximum benefit from these property advantages. the most preferred compositions of this type are those containing 4 to about 11 percent sebacic acid or dodecanedioic acid in conjunction with about 37 to about 48 percent of copolymer and about 55 to about 42 percent of hydrogenated triglyceride. As an alternative various mixtures of sebacic and dodecanedioic acid together constituting the total 1–14 percent of the dicarboxylic acid component may be used.

The low molecular weight ethylene/acrylic acid copolymers employed in the melt sizes of the present invention are themselves well known and commercially available materials. They may be made by methods disclosed in U.S. Pat. Nos. 3,520,861 and 4,515,317 or less preferably be precipitated from emulsion form as in U.S. Pat. No. 3,436,363. The disclosures of these patents are hereby incorporated by reference. Polymers containing substantially 80/20 weight proportions of ethylene to acrylic acid are best suited to the sizes of the present invention. Commercial polymers of this type are defined in terms of both composition and melt viscosity, which latter is expressed herein as determined by ANSI/ASTM Test Method D 1238–70 at Condition D. Polymers having a melt flow rate value of 250–550 grams per ten minutes according to this standard test are useful in our invention, with a polymer having a melt value of about 300 being preferred.

Hydrogenated or hardened tallow is a widely available by-product of the meat-packing industry made principally by hydrogenation of beef tallow. As such it is principally comprised of glyceryl tristearate, with lesser inclusions of mixed glycerides of $C_{14-20}$ saturated fatty acids. Principally because of its currently favorable price and availability, what is conventionally known as "fully hydrogenated" beef tallow (iodine number less than one) is the preferred triglyceride of the invention. Other fully hydrogenated triglycerides, for example those derived from oils and fats such as soybean oil, cottonseed oil, peanut oil, palm oil, lard, and tallows from sheep, goat, and other animal sources, would also be attractive in the present invention should they become economically competitive. Reference is made to the table of compositions of common vegetable and animal fats and oils in Kirk-Othmer, Encyclopedia of Chemical Technology, Vol. 6, pages 142–144 (1951). Therein it may be noted that the large majority of land-based vegetable and animal fats and oils comprise glycerides 85–95% of whose fatty acid constituents comprise $C_{14-18}$ saturated and unsaturated acids. When fully hydrogenated, these acids are converted essentially to stearic, palmitic, and myristic acids, the resulting triglycerides having thus become essentially identical to fully hydrogenated beef tallow; mixtures of these various waxes can also be used.

Expressly excluded from the category of triglycerides of the invention is castor wax, the fully hydrogenated derivative of castor oil. Because of the very high proportion of ricinoleic acid in castor oil, castor wax, with its correspondingly high content of 12-hydroxystearic acid moieties, is unsuitable for use as a major component in the melt sizes of the invention.

The fatty acid amides, also commercially known as hydrogenated tallow amides, and commonly made by reaction of free acids or hydrogenated tallow with ammonia, are typically mixtures of $C_{14-20}$ acid amides, principally stearamide. More chemically specific fatty acid amides may of course be employed in the invention, but they will naturally be more expensive.

Besides the named components, minor amounts of other agents such as tracer dyes, antioxidants, and the like may be added to the sizes of the invention, as desired.

Although other means may alternatively be employed, the methods and apparatus of U.S. Pat. No. Re. 29,287 are preferred for applying these sizes; the disclosure of this reissue patent is hereby incorporated by reference to the extent that it may be useful in describing the use of melt size compositions of our invention. Typically a predetermined amount of hydrogenated tallow is melted while being heated to near smoking temperature, and the ethylene/acrylic acid copolymer is added gradually with stirring until mixing is complete. Next the fatty acid amide or dicarboxylic acid, if it is to be employed, is stirred in, and the melt is then poured into suitably dimensioned pans or trays and allowed to cool to solid blocks of size. Rapid cooling is desirable, to minimize component separation. As described in the reissue patent, a size block is then pushed against and into the grooves of a heated applicator roll, typically at 350°-400° F., from which grooves size is taken up as the yarn passes tangentially or along an arc of the turning roll. Farther details will be found in the subsequent examples of the invention.

Desizing can be effected by either conventional alkaline aqueous scours or organic solvents, as with mixtures of petroleum solvents and methanol as described in commonly assigned U.S. application Ser. No. 22, 176, filed Mar. 20, 1979, now U.S. Pat. No. 4,253,840, the disclosure of which is hereby incorporated by reference.

Our experience has shown that in the field of melt sizing there exists a fine balance between the need for relatively high melting and application temperatures, to help insure rapid size solidification on the yarn, and the desire to prevent or at least minimize the tendency for the hot size to fume, smoke, and perhaps to thicken or gel on the applicator roll. Within the preferred application range of 350°-400° F. for the sizes of the present invention, a general preference for the indicated upper limit exists, so long as the sizing operation is proceeding smoothly and without periodic temporary shutdowns for adjustments, yarn breaks, and the like. At about 400° F. the size is less viscous and flows more freely onto the yarn than at 350° F. Although the tendency to fuming and smoking is naturally greater at the higher temperature, within the entire range it is minimal, much better than the applicants have observed with other high melting sizes.

The lower end of the preferred application temperature range offers greater protection against fuming and smoking, and in particular it markedly reduces the rate of thermally-induced reactions which otherwise might lead to gelling or other premature solidification of the size at the point of application. Heating the applicator roll at about 350° F. is thus preferred at start-up times and at other times where unscheduled delays might cause molten size to remain longer than desired on the applicator roll.

It is applicant's belief that the unusually high content of hydrogenated tallow in their sizes is to a considerable degree responsible for the outstanding sizing performance which has been observed.

Without wishing that the limits of their invention be bounded thereby except as defined in the appended claims, applicants believe that a certain desirable marginal incompatibility with each other of the components of their sizes may underlie the merits of their invention. This incompatibility is particularly manifest at the upper percentage levels of tallow, i.e., above about 55 percent tallow, most obviously in the two-component sizes.

For the most part, prior art teachings relating to melt sizing appear to advocate high degrees of compatibility of the components of the melt, one with the other. This is particularly evident in the aforementioned Japanese Publication No. 14280/1965. Applicants, on the other hand, have succeeded in inventing a limited range of sizes where the melts become miscible only at near their application temperatures and subsequently rapidly revert to incompatibility as they begin to cool and set on the yarn.

The compositional parameters of our invention have been established in view of the performance characteristics of our melt sizes. Based upon our observations and data it appears that above about 60 weight percent of ethylene/acrylic acid copolymer, having the prescribed 250-550 melt flow rate value, the compatibility of the molten components is if anything excessive. In any case the melt has become so viscous at and above this high percentage of polymer as to be almost unusable as a melt size. In a two-component melt system, when the polymer content drops below about 40 weight percent, the compatibility in the molten state is insufficient, leading to erratic and uneven sizing performance. The lower limit of copolymer content may be somewhat extended, i.e., to about 35 weight percent, by incorporation of small amounts of fatty acid amides without upsetting the precarious balance of the high-tallow melts. It is believed that the tallow serves within a few degrees of the application temperature as a dispersant for the polymer, but as cooling begins, enough phase separation occurs that the yarn becomes coated with a size film having a higher polymer content and more strength and flexibility than would be expected of such a high total tallow content if all the tallow had remained in a single blend phase on cooling.

A significant merit of the present invention which is thought to be related to the limited compatibility of the size components is that the sized yarn performs so well in the loom. Its lack of tendency to build up deposits on heddles and other loom parts is uncommonly good, especially in a size with such high wax content. This characteristic, which applicants associate with lack of tackiness of the sized yarn over wider than usual temperature ranges, is far more significant in a yarn sizing context than mere measurements of size film strengths and elongations.

Probably because of their unusually high resistance to tackiness, the sizes of the present invention can be applied successfully at much higher add-on than most melt sizes, without adverse effect upon either sizing or weaving performance. The aforementioned Japanese patent publication, for example, describes doubling, weaving, knitting, etc. difficulties encountered when application of its sizes exceeded 4 weight percent. The sizes of the present invention have been applied successfully to yarns of various types and dimensions in amounts ranging from 8 to 18 percent. Lower add-ons can be applied to less demanding yarns than the hairy spun yarns which have mostly been tested in the course of the invention. Loom performance has been superior.

DESCRIPTION OF THE PREFERRED EMBODIMENTS

In the examples which follow, several tests are now described that we consider simpler and more rapid than actual weaving. Many of these tests were employed to evaluate and screen candidate melt sizes of the present invention. As for the melt size composition preparation for initial laboratory screening, small samples of 80/20 ethylene/acrylic acid copolymer, having an indicated standard melt flow rate value (hereinafter referred to as SMFR), as determined by ANSI/ASTM D 1238-79 as Condition D, were melt-blended with designated amounts of hydrogenated tallow and tallow amide or dicarboxylic acid. Typically, for a 50/50 blend, a 30-gram portion of the copolymer was melted, into it was stirred 30 gm of hydrogenated tallow, and the melt was observed for clarity at 400° F. The melt was then poured into a 0.5×0.75×7-inch Teflon mold and allowed to cool. Larger-scale samples may be prepared in essentially the same way.

Brookfield viscosity measurements—A simple measurement useful in screening the sizes of the invention is the Brookfield viscosity, and more particularly the calculated coefficient of variation (COV) of a succession of Brookfield (Model LVF) viscosity measurements on the same melt. For these determinations a 10-gm portion of the molded size stick is melted in a constant-temperature bath, and the viscosity is measured at 400° F., with a No. 4 spindle, at 60 rpm. Ten successive measurements are taken, and then analyzed to determine their COV. Since the melts were known to gel if held molten overnight, it was recognized that the viscosity was moderately time-dependent; hence the measurements were taken as rapidly as possible, at about 30 seconds each.

For preliminary screening of the various size compositions on yarn, size was applied to six ends of yarn by urging an end of the molded size stick against a 6-groove laboratory model of the melt applicator roll of the type described in U.S. Pat. No. 29,287. The roll, heated at 400° F., was turned at 10 rpm in the direction of yarn travel while the yarns, traveling at 330 yards per minute (ypm) unless otherwise indicated, were passed through the grooves at the top of the roll. Tension in grams on the yarn during sizing was measured with a conventional tensiometer.

Abrasion test—As a screening means for estimating the relative resistance of the sized yarns to abrasion in a shuttle loom, a rapid abrasion test was applied to most of the test specimens. The device used consists of a vertically-mounted heddle eye affixed to the top of a short rod, the bottom of which rod is in turn clamped to the shaft of a horizontally-mounted air cylinder. The thrust of the cylinder is controlled to impart a horizontal reciprocating motion, 4 inches in each direction along a straight line, to the heddle eye. Above and parallel to the path of the cylinder shaft, and about one inch below the bottom of the heddle eye hole, are fixed a yarn clamp and a ⅛-inch rod, clamp and rod being ten inches apart with the heddle eye between them. Each yarn sample, for testing, is fixed in the clamp, passed through the heddle eye, and hung over the rod with a 90-gm weight attached to put tension on the yarn. Thus, at the midpoint of the 4-inch heddle eye stroke, the yarn forms an isosceles triangle, one inch high, with the 10-inch line between yarn clamp and drape rod. Better to simulate the action of a loom, the plane of the heddle eye is set about 20° away from normal to the yarn line, as heddles are set in a loom. The device operates at a rate of about 150 reciprocations per minute. A counter records the number of reciprocations.

In the abrasion apparatus as described, the 90-gm weight on the yarn, generally intended to approximate the tension in a loom, makes the test a very rigorous one. Each counted reciprocation or stroke of the heddle eye comprises a trip over and back to the starting point. The operator watches the yarn very carefully as testing begins, and when the yarn begins to deteriorate, which with a poor size is practically at once, the counter reading is recorded. If the number of strokes to break are desired, the device continues until the yarn breaks. At least 20 specimens of each yarn are tested to reach an average, which typically is in the 3.0 to 5.0 range for a "good" yarn. Strokes-to-break for such yarns are in the range of 200–250. Deterioration is judged to represent a point, considerably short of formation of fuzz balls, where the roughed-up and hairy yarn surfaces of adjacent yarns in a warp would be likely to cause intra-warp friction and snagging under the action of a loom. The 90-gm weight, with its attendant low but imprecise test numbers, has been retained in the interest of speed and efficiency in screening out likely failures among a large number of samples. Good correlation has been observed between a relatively high rating in the test and actual performance in a commercial loom.

Size build-up–Another test for screening the potential of melt sizes to perform well in a loom involved estimating the tendency of the size to build up on loom parts. The apparatus comprises a ⅛×12-inch stainless steel rod, mounted essentially horizontal (bowed 0.5 inch in six toward the center) on a reciprocating wooden platform, whereby a 4-inch movement of the rod in each direction along its axis is produced. A thermocouple is attached to the bottom of the rod at its center, for the purpose of determining temperature changes in the rod. On each side of the rod, parallel to it and 7 inches away, is mounted a 0.5-inch aluminum bar. The center of the rod rises 1.5 inches above the plane of the two bars. Outside and slightly below the bars are two beams for supplying and taking up a test warp of yarns.

For a full test of yarn on this apparatus, 90 ends of melt-sized yarn are beamed to provide about 30 yards of warp. The warp is fed up over the first aluminum bar, across the stainless steel rod and the second bar, and downward through a 4.5-inch comb to the take-up beam, under a tension of 100–110 gm/end supplied by braking weights hung from the feed beam. The warp is drawn across the apparatus at about ten yards per hour. Meanwhile the rod rubs across the bottom of the warp at about 150 reciprocations per minute. Friction of the warp on the test rod is judged by recording the rod temperature, which typically rises from room temperature to about 105° F. during testing of an effective size, to as high as 125° F. with a marginal or poor size. Other evidence of poor size performance is lateral or rolling action of the warp, which indicates its sticking or seizing on the rod, in which event the test usually is terminated early. When a given warp survives the passage of its full 30 yards, the rod is carefully examined for evidence of size sticking to it, and if none is found, "no deposit" is recorded and the size is regarded as a candidate for a full weaving test. Note is taken of the possible presence of loose dust on the wooden platform, as an indication of the dusting potential of the size in a loom.

Melt separation-Besides the observations, as noted herein, of degree of melt haziness at 400° F., another evaluation of the degree of homogenity of the melts was also employed in some instances. This involved observing the approximate temperature of melt commpatibility of the blends, defined as the point where a stirred melt no longer exhibits evidence of stringiness, lumps, swollen blobs, or the like in the molten fluid when the stirrer is raised and lowered out of and into the melt. It is also characteristic of this temperature point that below it the wax component tends to separate into a floating layer on top of the copolymer when stirring is discontinued. Above this temperature the melt blend, though still somewhat hazy in appearance, exhibits no such component layers.

The following examples refer to the above-described tests; unless otherwise indicated all parts and percentages are by weight. In the appended claims the total weight percentage of the indicated components is 100%. When included a component is present in at least an amount of 0.1 weight percent.

EXAMPLE 1

Equal portions of hydrogenated tallow and 80/20 ethylene/acrylic acid (EAA) copolymer having an SMFR of 500 were melted together. The Brookfield viscosity of the size was 825–850 cps. Size add-on to 25/1 65/35 polyester/cotton yarn with the 1-inch grooved roll at 400° F. was 15.7 percent, the sizing operation being smooth throughout. On the abrasion tester the sized yarn gave a favorable reading of 5.2 strokes to deterioration, 202 strokes to break. On the size build-up tester, the sized warp went the entire 30 yards, and there was no deposit on the test rod at the end of the test.

EXAMPLE 2

With a 50/50 melt size similar to that of Example 1, except that the copolymer had an SMFR of 300, the size level on polyester/cotton yarn was 19.2 percent, and the abrasion test reading was 6.8 strokes to deterioration. The sized warp rated "no deposit" in the build-up test.

EXAMPLE 3

A series of screening experiments employing 300 SMFR EAA copolymer in melt combination with varying weight proportions of hydrogenated tallow were carried out according to the general procedure of Example 1. The results after size preparation, application to polyester/cotton yarn, and testing as hereinbefore detailed are given in Table 1.

TABLE I

EAA/Tallow Melt Application to Polyester/Cotton Yarn

| EAA/Tallow wt. ratio | Brookfield Viscosity Average cps | Brookfield Viscosity COV % | Sizing Tension gms | Add-on % | Abrasion Strokes |
|---|---|---|---|---|---|
| 40/60* | 330 | 12.7 | 32 | 14.2 | 3.6 |
| 45/55 | 720 | 1.9 | 37 | 17.3 | 4.0 |
| 50/50 | 1050 | 1.5 | 40 | 16.1 | 4.9 |
| 55/45 | 1420 | 2.1 | 42 | 14.8 | 4.7 |
| 60/40* | 1920 | 1.3 | 45 | 12.9 | 4.7 |

*not according to the invention

These data show that the mid-range EAA/tallow ratios give results indicating essentially identically favorable performance characteristics. At the high-copolymer 60/40 ratio, however, two faults begin to emerge. One is evident from the data, which show that the viscosity is higher than desirable, and that this is causing undue yarn tension during the sizing operation. The other fault is less obvious. From these and similar experiments we have learned to be suspicious of sizes—outside the claimed scope of the invention—where melt components appear to be overly compatible. In the series of Table 1 the 60/40 EAA/tallow composition is the only one where the melt was completely clear at 400° F., the others being more or less cloudy or hazy at this temperature. This observed haziness appears to be a sign of the marginal compatibility which evidently leads to superior melt-sizing performance. Associated with the high compatibility of the 60/40 EAA/tallow melt is a lower than average coefficient of variation in successive Brookfield viscosity measurements.

At the top of the table, the 40/60 EAA/tallow combination (also not according to the invention) suffers from an opposite fault, exemplified in its excessive COV of 12.7. Such a high level of variation in the successive Brookfield measurements is indicative of a very non-uniform melt and of poor miscibility of the components. Not only was this high-tallow composition excessively hazy at 400° F. in comparison with the other melts, but on close examination it was apparent that the melt was distinctly non-uniform, with visible evidence of insufficiently dispersed polymer.

The data and observations indicate that for the two-component melts of the invention there exists a plateau of favorable sizing properties between about 55/45 and 45/55 weight proportions of EAA to tallow, centering on approximately 50/50 proportions.

EXAMPLE 4

In a further series of screening experiments it was found that the lower limit of EAA content in the EAA/tallow compositions could be lowered somewhat by resort to a 3-component composition, i.e., by adding a small proportion of fatty acid amide, thereby extending the miscibility range shown in Table 1. The procedure was that of Example 1, using 300 SMFR EAA copolymer. After the copolymer was stirred into molten hydrogenated tallow, prescribed amounts of hydrogenated tallow amide were then stirred in at about 400° F., and size sticks were prepared as before. Experimental results are given in Table 2. For purposes of comparison, the results for the 40/60 EAA/tallow run of Table 1 are also included. The results in Table 2 are based on a fixed copolymer content of 40 percent.

TABLE 2

EAA/Tallow/Amide Melt Application to Polyester/Cotton Yarn (EAA Fixed at 40 Percent)

| EAA/Tallow/Amide wt. ratio | Brookfield Viscosity Average cps | Brookfield Viscosity COV % | Sizing Tension gms | Add-on % | Abrasion Strokes |
|---|---|---|---|---|---|
| 40/60/0* | 330 | 12.7 | 32 | 14.2 | 3.6 |
| 40/58.8/1.2 | 500 | 3.8 | 32 | 13.9 | 3.3 |
| 40/57.6/2.4 | 470 | 3.3 | 33 | 13.6 | 3.0 |
| 40/56.4/3.6 | 440 | 2.1 | 34 | 16.0 | 4.2 |
| 40/55.2/4.8 | 410 | 3.2 | 34 | 12.0 | 3.7 |
| 40/54/6 | 460 | 3.1 | 25 | 17.7 | 2.9 |
| 40/51.6/8.4* | 370 | 3.1 | 27 | 14.6 | 3.2 |

*not according to the invention

For these 40 percent EAA compositions containing hydrogenated tallow amide, the results clearly show that the excessive incompatibility problems associated with the 40/60 EAA/hydrogenated tallow size of Table 1 have been largely eliminated. Throughout the range of these 3-component compositions the data are entirely satisfactory and the degree of incompatibility, as measured by the COV, is within the requirements for a melt size. The only observed limitation was that a tendency toward excessive brittleness and dusting was observed in the compositions containing 6% and 8.4% hydrogenated tallow amide.

EXAMPLE 5

The range of compositions evaluated in Example 4 was extended by lowering the EAA content to 35 percent, and then to 30 percent. The results are shown in Table 3.

TABLE 3

EAA/Tallow/Amide Melt Application to Polyester/Cotton Yarn (EAA at 35 and 30 percent)

| EAA/Tallow/ Amide wt. ratio | Brookfield Viscosity Average cps | Brookfield Viscosity COV % | Sizing Tension gms | Add-on % | Abrasion Strokes |
|---|---|---|---|---|---|
| 35/61.4/3.6 | 310 | 3.2 | 30 | 14.1 | 3.1 |
| 35/59/6 | 300 | 4.7 | 29 | 15.5 | 3.5 |
| 30/66.4/3.6* | 210 | 6.6 | 28 | 14.8 | 2.3 |
| 30/64/6* | 180 | 6.6 | 23 | 18.6 | 2.6 |

*not according to the invention

These data show that the content of ethylene/acrylic acid copolymer can be reduced below 40 percent, but that below about 35 percent the COV clearly indicates excessive incompatibility in the combinations. Additionally, at 30 percent copolymer content, the abrasion resistance of the sizes is inadequate.

EXAMPLE 6

In a commercial scale-up of the warp sizing of 25/1 65/35 polyester/cotton, 400 ends of yarn were sized on a 600-groove melt applicator roll, with the roll temperature at 350°–360° F., the roll speed at 11.5 rpm, and the block feed rate at about one inch per minute. The yarn speed was 380 ypm, and the size add-on averaged about 13 percent. The size was a 50/50 melt blend of 300 SMFR 80/20 ethylene/acrylic acid copolymer with hydrogenated tallow, in the form of blocks $\frac{7}{8}$-inch thick. The yarn was taken up on section beams until each of ten beams contained 3200 yards of sized yarn. The section beams were then rewound onto two Sulzer loom beams, each containing 3992 warp ends.

The beams were mounted on a double-warp Sulzer loom for weaving of 120-inch sheeting fabric. The weaving performance, based on the number of warp stops and on loom efficiencies, was compared with weaving of other conventionally aqueous-sized warp weaving the same style in the same weave area. The hot-melt-sized warp averaged only 46.3% of the warp-related loom stops of the conventional warps, and its loom efficiency was about 5% higher than those of the conventionally-sized warps.

EXAMPLE 7

A melt blend composed of 45% of 300 SMFR 80/20 ethylene/acrylic acid copolymer, 48% hydrogenated tallow, and 7% sebacic acid was heated until the melt became compatible, as defined above, at about 280° F., a temperature about 70° F. lower than the temperatures generally observed for a variety of proportions of copolymer and tallow in the 2-component sizes of the invention. The size was preliminarily screened by application to yarn as in Example 1, at a level of 12.5%. On the abrasion tester the sized yarn gave favorable results, comparable to those of the 2-component sizes of the invention.

EXAMPLE 8

A similar melt blend of 50% copolymer, 46% hydrogenated tallow, and 4% sebacic acid also became compatible at about 280° F. The most promising property observed with this melt was its surprising resistance to gelation on long heating. When Brookfield viscosity measurements were taken (No. 4 spindle, at 60 rpm) on a melt held at 350° F., the 1700 cps starting viscosity had risen only to 2350 cps after 24 hours, and to 5000 cps after 48 hours.

EXAMPLE 9

Another melt blend, composed of 47.5% copolymer, 47% hydrogenated tallow, and 5.5% sebacic acid, also became compatible at about 280° F. In the Brookfield viscosity test of Example 8 the starting viscosity of 1200 cps rose to 1250 cps in 24 hours, to 2500 cps in 48 hours, and to 5300 cps in 90 hours, still without gelation appearing. Compared to tests with similar compositions less the dibasic acid, such long resistance to thermal degradation was most unexpected.

EXAMPLE 10

A melt blend of 32% copolymer, 59% hydrogenated tallow, and 9% sebacic acid became compatible somewhat later, at 300° F., but a film cast from the melt was judged too brittle to indicate utility as a melt size.

EXAMPLE 11

A melt blend of 47.5% copolymer, 47% hydrogenated tallow, and 5.5% dodecanedioic acid became compatible at 280° F., and showed resistance to gelation comparable to the melts of Examples 8 and 9. Under the conditions of Example 8, except that the melt temperature was 360° F., the initial Brookfield viscosity of 1326 cps rose to only 1598 cps in 24 hours, to 1748 cps in 32 hours, and to 2894 cps in 56 hours. On the Instron tester, samples taken from a 3.5-mil film cast from a fresh melt of this composition gave an average tensile strength measurement of 954 psi and an elongation-to-break of 430%, values compatible to others from the best sizes of the invention.

EXAMPLE 12

In view of the undesirable brittleness of the film of Example 10, a melt blend was prepared from 35.0% of 300 SMFR 80/20 ethylene/acrylic acid copolymer, 54.5% hydrogenated tallow, and 10.5% sebacic acid. In the Brookfield viscosity test, designed to evaluate the resistance to gelation on long heating, the size of this example showed unusually promising laboratory test results, even after 48 hours at 365° F., which is much longer than would be required in practice.

Essentially identical laboratory evaluation results were obtained when the sebacic acid component was substituted by an equal weight of dodecanedioic acid. Warp yarn (26/1 65/35 polyester/cotton) sized with about 8% of the product wove well on a Ruti air-jet loom. The same yarn sized at a 9% level wove well on a Suzler missile loom.

EXAMPLE 13

Raising the copolymer content to 38.0%, in conjunction with 53.0% hydrogenated tallow and 9.0% dodecanedioic acid, produced a melt size composition exhibiting no more than the usual insignificant increase in Brookfield viscosity after 24 hours of heating at 365°

F. An observed slight loss of resistance after longer heating at this temperature was thought of no practical significance. The product was judged to be as good a melt size as the superior product of Example 12.

EXAMPLE 14

A further upward adjustment of the copolymer content to 39.0%, along with 51.0% hydrogenated tallow and 10.0% dodecanedioic acid, produced a size which tested essentially the same as that of Example 13. Applied in the laboratory at levels of 8 to 10 percent to several yarns of varying hairiness, the composition once more proved an effective warp size, perhaps better than that of Example 12 for sizing the hairier yarns because of better fiber-laying capability, afforded by its higher polymer content.

EXAMPLE 15

In this example the percentages of both copolymer and dicarboxylic acid were raised still further, namely to 40.35% copolymer, 47.55% tallow, and 12.1% dodecanedioic acid. The resistance of the product to long heating, specifically for 48 hours at 365° F., was nearly as good as that of the superior product of Example 12, and its overall properties made it look generally favorable as a size candidate. However, when the product was viewed from a practical standpoint, no advantages sufficient to justify the higher content of the more expensive components were found. Further, it was felt that the upper limit for the content of dicarboxylic acid was being approached; i.e., that using much more of it would make the size components too compatible with each other.

EXAMPLE 16

A further increase in copolymer content to 42.0%, conjunction with 49.5% hydrogenated tallow and 8.5% dodecanedioic acid, produced a size of the invention generally comparable with those of the other examples.

Although especially suitable for the sizing of polyester/cotton yarns, the melt sizes of the invention are also suited to the sizing of other natural and synthetic yarns, such as 100% cotton, 100% wool, wool/cotton, wool/-polyester and others.

This invention may be embodied in other forms or carried out in other ways without departing from the spirit or essential characteristics thereof. The present embodiments are thus illustrative, the scope of our invention being indicated by the appended claims and the equivalents embraced therein.

What is claimed is:

1. A quick-setting, non-aqueous, water-extractable textile melt size composition comprising an intimate mixture of about 42 to about 58 weight percent of substantially 80/20 ethylene/acrylic acid copolymer, about 58 to about 42 weigth percent of a wax derived by full hydrogenation of animal and plant tallows and oils, excluding castor wax, said size capable of being applied as a melt to textile yarns, with quick setting when exposed to ambient conditions, and capable of being removed from the yarns by aqueous or alkali extraction.

2. The size of claim 1 in which the copolymer has a standard melt flow rate value of about 250 to 550 when determined by ANSI/ASTM D 1238-79 at Condition D.

3. The size of claim 1 in which the amount of copolymer is from about 45 to about 55 weight percent and the amount of wax is about 55 to about 45 weight percent.

4. The yarn sized with the composition of claim 1.

5. The sized yarn of claim 4 in which the yarn contains polyester, rayon, a blend of polyester and rayon, cotton, a blend of polyester and cotton, polypropylene, wool or glass.

6. A quick-setting, non-aqueous, water-extractable textile melt size composition comprising an intimate mixture of about 35 to about 50 weight percent of substantially 80/20 ethylene/acrylic acid copolymer, about 60 to about 40 weight percent of a wax derived by full hydrogenation of animal and plant tallows and oils, excluding castor wax, and from about 1 to about 14 weight percent of sebacic acid of dodecanedioic acid, said size capable of being applied as a melt to textile yarns, with quick setting when exposed to ambient conditions, and capable of being removed from the yarns by aqueous or alkali extraction.

7. The size of claim 6 in which the copolymer has a standard melt flow rate value of about 250 to 550 when determined by ANSI/ASTM D 1238-79 at Condition D.

8. The size of claim 6 in which the amount of copolymer is from about 37 to about 48 weight percent, the amount of wax is from about 55 to about 42 weight percent, and the amount of sebacic or dodecanedioic acid is from about 4 to about 11 weight percent.

9. A yarn sized with the composition of claim 6.

10. The sized yarn of claim 9 in which the yarn contains polyester, rayon, a blend of polyester and rayon, cotton, a blend of polyester and cotton, polypropylene, wool or glass.

11. A quick-setting, non-aqueous, water-extractable textile melt size composition comprising an intimate mixture of about 35 to about 45 weight percent of substantially 80/20 ethylene/acrylic acid copolymer, about 62 to about 54 weight percent of a wax derived by full hydrogenation of animal and plant tallows and oils, excluding castor wax, and from about 1 to about 7 weight percent of a fatty acid amide, said size capable of being applied as a melt to textile yarns, with quick setting when exposed to ambient conditions, and capable of being removed from the yarns by aqueous or alkali extraction.

12. The size of claim 11 in which the copolymer has a standard melt flow rate value of about 250 to 550 when determined by ANSI/ASTM D 1238-79 at Condition D.

13. The size of claim 11 in which the amount of copolymer is from about 38 to about 42 weight percent, the amount of wax is from about 60 to about 56 weight percent, and the amount of amide is about 2 to about 5 weight percent.

14. The yarn sized with the composition of claim 11.

15. The sized yarn of claim 14 in which the yarn contains polyester, rayon, a blend of polyester and rayon, cotton, a blend of polyester and cotton, polypropylene, wool or glass.

16. In a process for sizing textile yarns by applying a size composition to textile yarn, the improvement comprising using, as said size composition, a quick-setting, non-aqueous, water-extractable textile melt size composition comprising an intimate admixture of about 42 to about 58 weight percent of substantially 80/20 ethylene/acrylic acid copolymer together with about 58 to 42 weight percent of a wax derived by full hydrogenation of animal and plant tallows and oils, excluding castor wax, and applying the size composition to the textile yarn as a melt, wherein the size composition is characterized by a rapid setup and absence of tackiness when the sized yarn is led away from the point of application of the size composition to the yarn, the size composition being capable of removal from the textile yarn by aqueous extraction media.

17. In a process for sizing textile yarns by applying a size composition to textile yarn, the improvement comprising using, as said size composition, a quick-setting, non-aqueous, water-extractable textile melt size composition comprising an intimate admixture of about 35 to about 50 weight percent of substantially 80/20 ethylene/acrylic acid copolymer, about 60 to about 40 weight percent of a wax derived by full hydrogenation of animal and plant tallows and oils, excluding castor wax, and from about 1 to about 14 weight percent of sebacic acid or dodecanedioic acid and applying the size composition to the textile yarn as a melt, wherein the size composition is characterized by a rapid setup and absence of tackiness when the sized yarn is led away from the point of application of the size composition to the yarn, the size composition being capable of removal from the textile yarn by aqueous extraction media.

18. In a process for sizing textile yarns by applying a size composition to textile yarn, the improvement comprising using, as said size composition, a quick-setting, non-aqueous, water-extractable textile melt size composition comprising an intimate admixture of about 35 to about 45 weight percent of substantially 80/20 ethylene/acrylic acid copolymer together with about 62 to about 54 weight percent of a wax derived by full hydrogenation of animal and plant tallows and oils, excluding castor wax, and from about 1 to about 7 weight percent of a fatty acid amide and applying the size composition to the textile yarn as a melt, wherein the size composition is characterized by a rapid setup and absence of tackiness when the sized yarn is led away from the point of application of the size composition to the yarn, the size composition being capable of removal from the textile yarn by aqueous extraction media.

* * * * *